US008985523B2

(12) United States Patent
Chadwick et al.

(10) Patent No.: US 8,985,523 B2
(45) Date of Patent: Mar. 24, 2015

(54) RAILWAY SYSTEM USING ACOUSTIC MONITORING

(75) Inventors: Simon Chadwick, Devizes (GB); Mark Glover, Chippenham (GB); Ian Priest, Chippenham (GB); Mike Chapman, Chippenham (GB); James McQuillan, Chippenham (GB)

(73) Assignee: Siemens Rail Automation Holdings Limited, Surrey (GB)

( * ) Notice: Subject to any disclaimer, the term of this patent is extended or adjusted under 35 U.S.C. 154(b) by 0 days.

(21) Appl. No.: 13/393,950

(22) PCT Filed: Sep. 3, 2010

(86) PCT No.: PCT/GB2010/051467

§ 371 (c)(1), (2), (4) Date: May 11, 2012

(87) PCT Pub. No.: WO2011/027166

PCT Pub. Date: Mar. 10, 2011

(65) Prior Publication Data

US 2012/0217351 A1 Aug. 30, 2012

(30) Foreign Application Priority Data

Sep. 3, 2009 (GB) ..... 0915322.2

(51) Int. Cl.
*B61L 3/12* (2006.01)
*B61L 29/32* (2006.01)
(Continued)

(52) U.S. Cl.
CPC ..... *B61L 29/32* (2013.01); *B61L 23/06* (2013.01); *B61L 25/021* (2013.01); *B61L 25/025* (2013.01); *B61L 29/18* (2013.01)
USPC ..... 246/167 R; 246/169 S

(58) Field of Classification Search
CPC ..... B61L 23/06; B61L 25/021; B61L 25/025; B61L 29/18; B61L 29/32; B61L 1/06; B61L 23/044; B61L 3/04; B61L 3/20; B61L 23/041; B61K 9/10; B61K 9/00; B61K 9/08
USPC ..... 246/167 R, 169 S
See application file for complete search history.

(56) References Cited

U.S. PATENT DOCUMENTS 4,843,885 A * 7/1989 Bambara ..... 73/660
5,029,477 A * 7/1991 Bambara ..... 73/660
(Continued)

FOREIGN PATENT DOCUMENTS

DE 42 14 580 A1 11/1993
DE 10 2007 006 833 A1 8/2008
(Continued)

OTHER PUBLICATIONS

International Search Report dated Jan. 21, 2011 for International Application PCT/GB2010/051467, 7 sheets.

*Primary Examiner* — Jason C Smith
(74) *Attorney, Agent, or Firm* — Laurence A. Greenberg; Werner H. Stemer; Ralph E. Locher

(57) ABSTRACT

A method of monitoring and/or controlling components of a railway system which includes a track and at least one train that is operable to run on said track, comprises the steps of: a) providing an acoustic transducer proximate the railway for picking up acoustic signals; b) receiving acoustic signals from the transducer; and c) analyzing the received signals.

15 Claims, 4 Drawing Sheets

Figure 1:
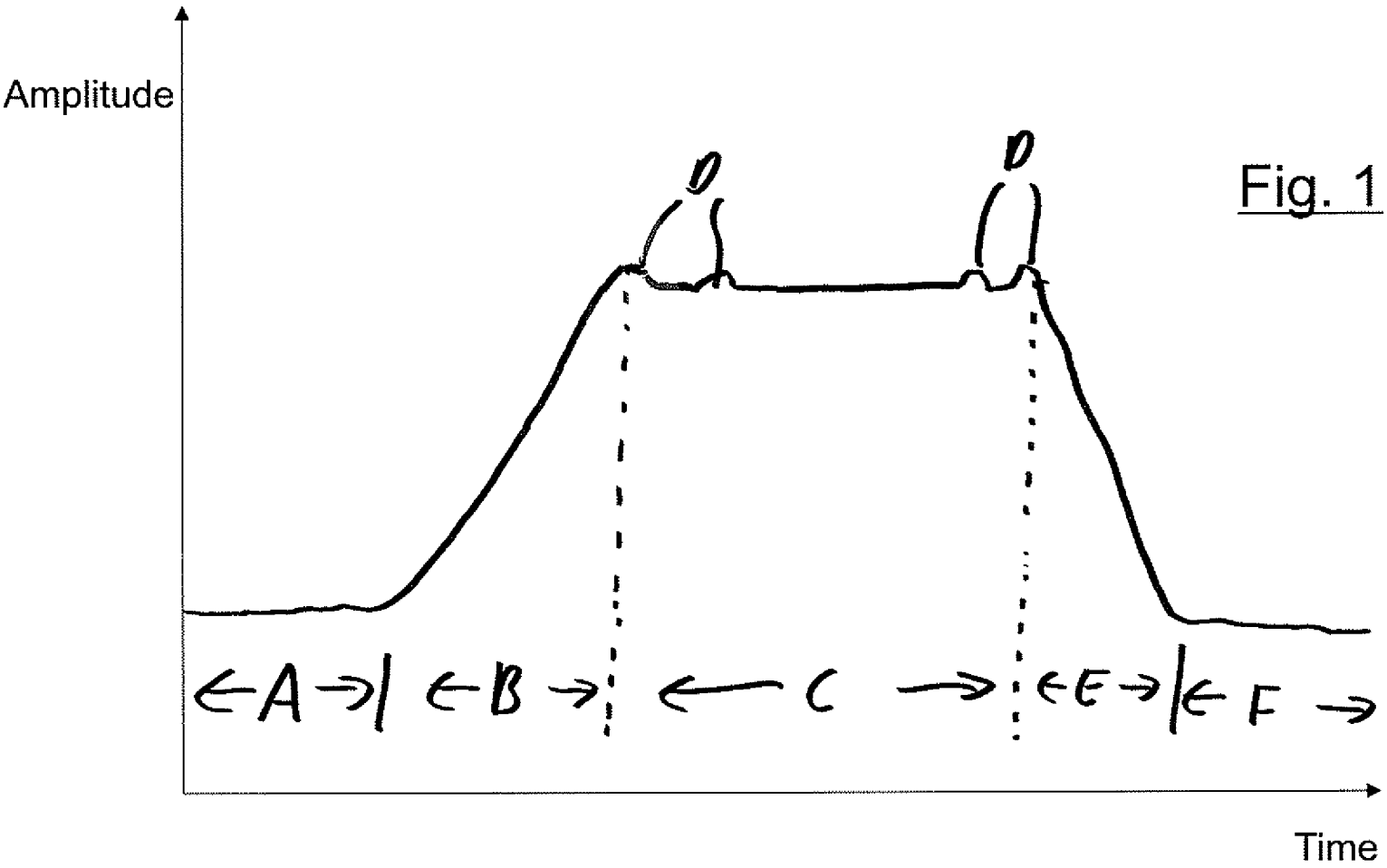

(51) Int. Cl.

| | |
|---|---|
| ***B61L 23/06*** | (2006.01) |
| ***B61L 25/02*** | (2006.01) |
| ***B61L 29/18*** | (2006.01) |

(56) References Cited

U.S. PATENT DOCUMENTS

| | | | | |
|---|---|---|---|---|
| 5,713,540 | A * | 2/1998 | Gerszberg et al. | 246/121 |
| 6,216,985 | B1 * | 4/2001 | Stephens | 246/120 |
| 6,830,224 | B2 * | 12/2004 | Lewin et al. | 246/167 R |
| 6,951,132 | B2 * | 10/2005 | Davenport et al. | 73/598 |
| 8,160,832 | B2 * | 4/2012 | Luo et al. | 702/99 |
| 2004/0261533 | A1 * | 12/2004 | Davenport et al. | 73/659 |
| 2009/0001226 | A1 * | 1/2009 | Haygood | 246/169 S |
| 2009/0266943 | A1 * | 10/2009 | Kumar et al. | 246/28 R |
| 2011/0093144 | A1 * | 4/2011 | Goodermuth et al. | 701/20 |
| 2011/0186692 | A1 * | 8/2011 | Kumar et al. | 246/29 R |
| 2012/0074266 | A1 * | 3/2012 | Daum et al. | 246/186 |
| 2012/0097803 | A1 * | 4/2012 | Daum et al. | 246/184 |
| 2012/0217351 | A1 * | 8/2012 | Chadwick et al. | 246/169 R |

FOREIGN PATENT DOCUMENTS

| | | |
|---|---|---|
| GB | 137433 | 1/1920 |
| WO | WO 91/10584 | 7/1991 |

* cited by examiner

RAILWAY SYSTEM USING ACOUSTIC MONITORING

CROSS-REFERENCED TO RELATED APPLICATION(S)

This application is a National Phase Patent Application of International Application Number PCT/GB2010/051467, filed on Sep. 3, 2010, which claims priority to and the benefit of British application No. 0915322.2, filed Sep. 3, 2009.

The present invention relates to a method of monitoring and/or controlling components of a railway system, a method for predicting the time at which a train will arrive at a level crossing and apparatus for monitoring and/or controlling components of a railway system.

Recent development in fibre optic sensing technology offers opportunity for a number of advances that can be made in the field of railway sensing and control.

It is an aim of the present invention to provide improved systems and methodologies for train and railway control, operation and security.

This aim is achieved by 'listening' to the trackside environment and allow information to be derived for a number of uses. This 'listening' may make use of fibre optic hydrophony.

In accordance with a first aspect of the invention there is provided a method of monitoring and/or controlling components of a railway system which includes a track and at least one train that is operable to run on said track, comprising the steps of:

a) providing an acoustic transducer proximate the railway for picking up acoustic signals;

b) receiving acoustic signals from the transducer; and c) analysing the received signals.

In accordance with a second aspect of the invention there is provided a method for predicting the time at which a train will arrive at a level crossing, comprising the steps of:

a) providing at least two spaced apart acoustic transducers proximate a train track;

b) monitoring signals received from said transducers;

c) identifying a signature associated with said train from said received signals;

d) determining the speed of said train from analysis of said signatures; and e) estimating the arrival time of the train using the determined speed.

In accordance with a third aspect of the present invention there is provided apparatus for monitoring and/or controlling components of a railway system which includes a track and at least one train that is operable to run on said track, comprising: an acoustic transducer proximate the railway for picking up acoustic signals; a receiver for receiving acoustic signals from the transducer; and processing means for analysing the received signals. As is well understood, acoustic waves emitted from a source act to cause incident objects to vibrate. Vibrations on the outer surface of a fibre optic cable cause changes in the refractive properties experienced by light passing through the cable, which may for example be analysed using computer algorithms in order to determine where on the cable such vibration is being experienced, and additionally the frequency and amplitude of such disturbance. This is analogous to turning the cable into one or a series of microphones.

The systems described below all use the same basic principle of 'listening' to the trackside environment or train vehicles as they pass an acoustic transducer, for example a fibre optic cable. In all cases computer-based analysis of the vibration vs time signature (or a frequency domain version of the same) may be used in order to identify a particular case.

It should be noted that existing rail tracks are often already provided with at least one fibre optic cable positioned adjacent to the track, so that communications signals may be transmitted therethrough. Typically, a bundle of fibres are provided, of which some will be "dark", i.e. unused in normal operation. Advantageously, such dark fibres may be used as the acoustic transducers in accordance with the present invention. It is not essential to use dark fibres however, for example "light" communications carrying fibres may be used, in which case it is necessary to distinguish between the communications and acoustic signals, which can be achieved using electronic filters for example. As a further alternative, new optical fibre may be laid at or adjacent to the track for the purpose of hydrophony.

Figure 2:
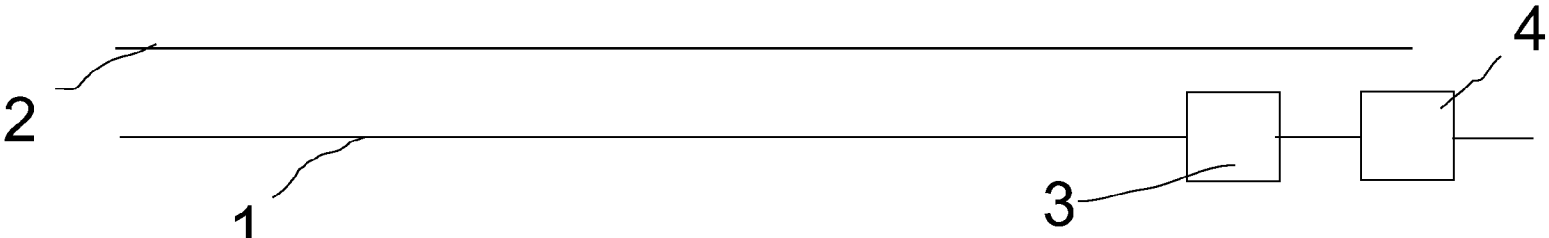
Figure 3:
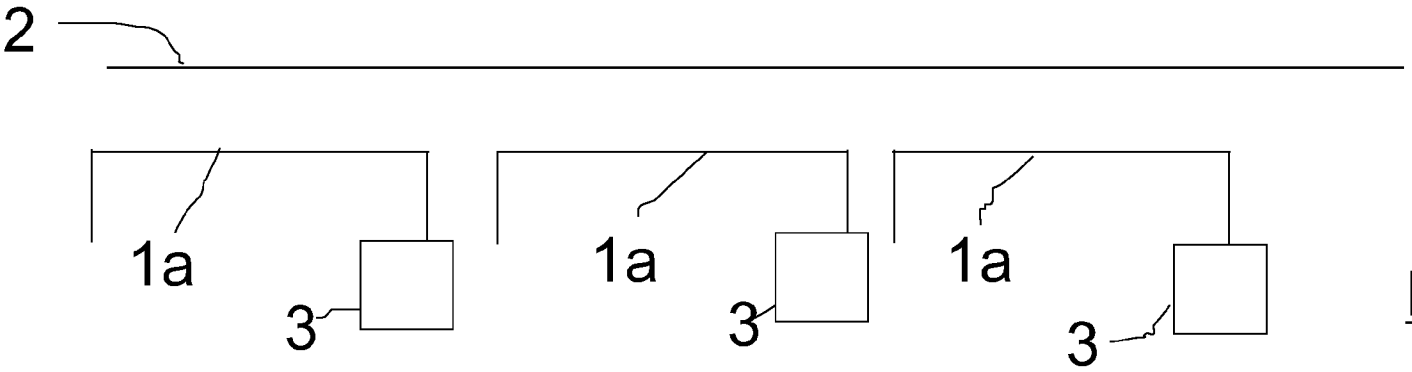
Figure 4:
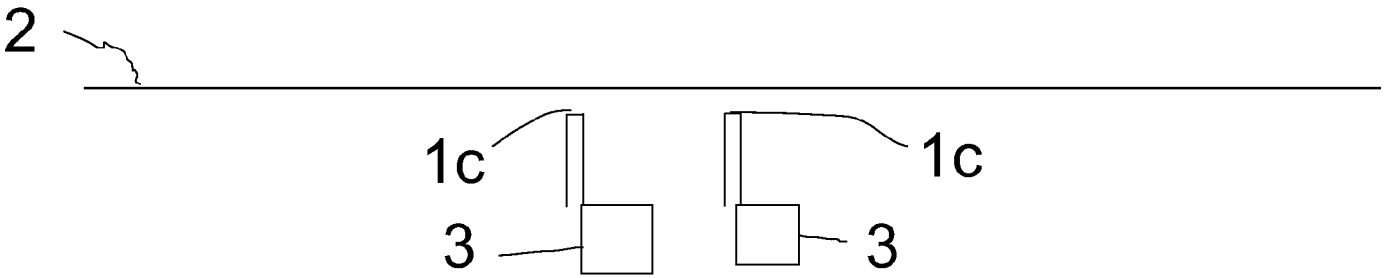
Figure 5:
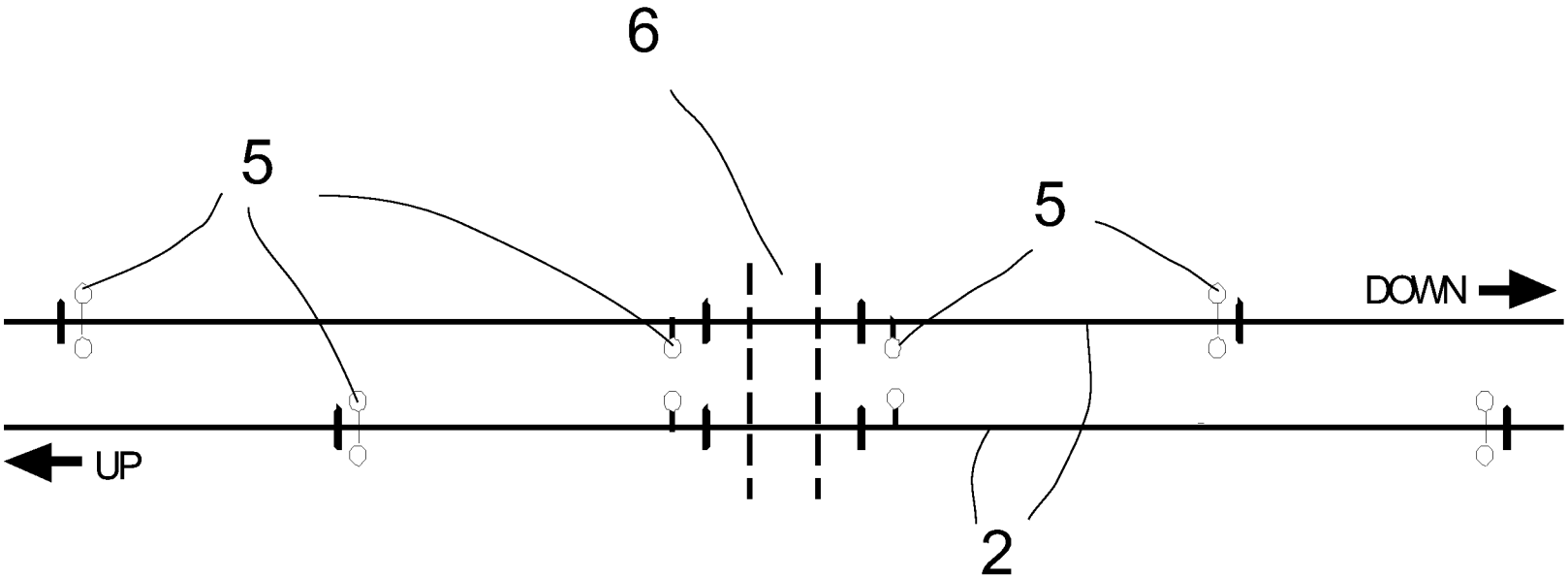

The invention will now be described with reference to the accompanying figures, of which:

FIG. 1 schematically shows a theoretical train signature in the amplitude vs time domain;

FIG. 2 schematically shows a first possible optical fibre arrangement;

FIG. 3 schematically shows a second possible optical fibre arrangement;

FIG. 4 schematically shows a third possible optical fibre arrangement;

FIG. 5 schematically shows a conventional level crossing predictor; and

Figure 6:
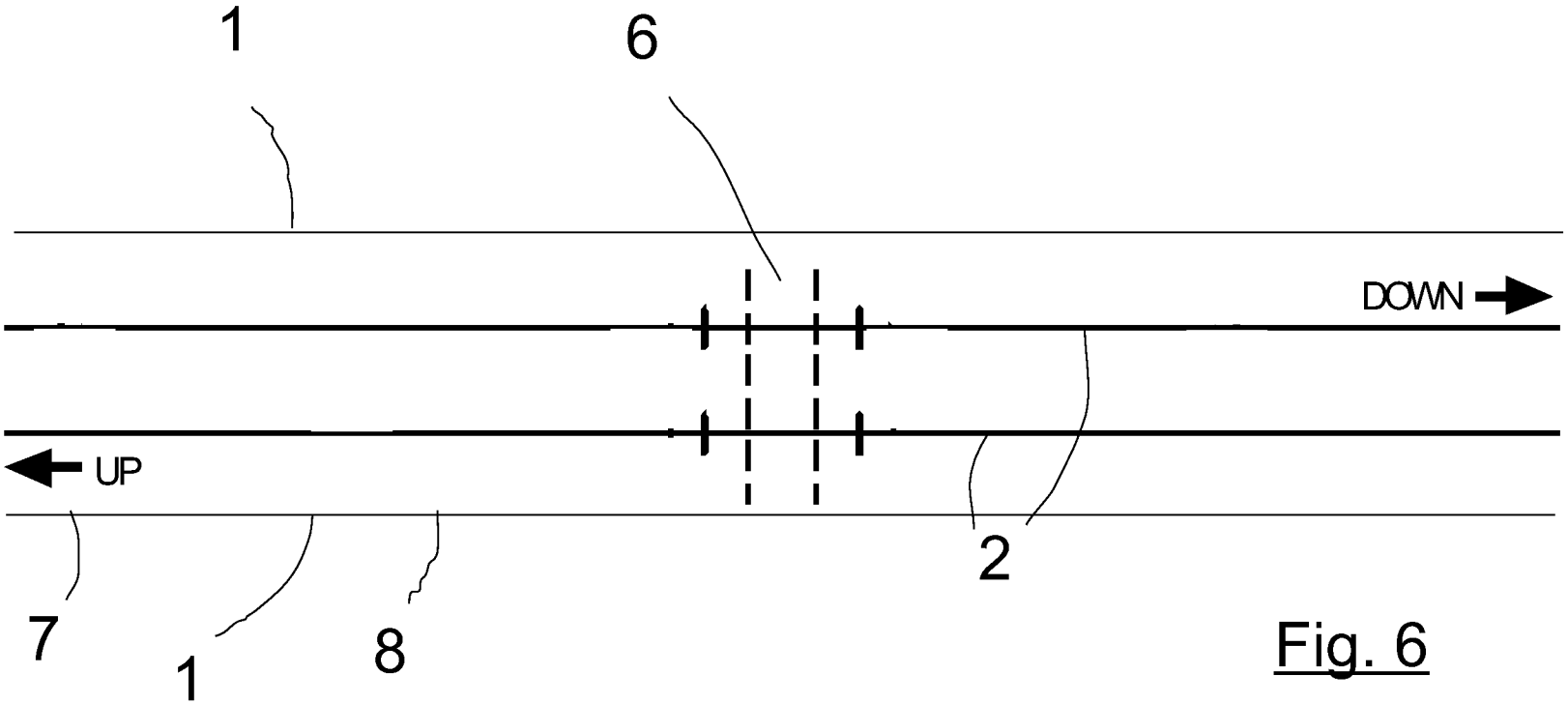

FIG. 6 schematically shows a level crossing predictor in accordance with a first embodiment of the present invention.

The signature of a train will be characterised by a series of frequencies at various amplitudes caused by the passage of the wheel along the rail, in particular there will be specific peaks as an axle passes a given point. It is therefore possible to determine not only that a train has passed a particular location on the railway, but also to determine further information such as train length, the number of axles of the train, the condition of equipment on that train, and the condition of fixed equipment such as the track itself or trackside equipment.

FIG. 1 schematically shows a theoretical signature in the amplitude vs time domain for a train operating normally. For simplicity, the train is assumed to be simple, for example a "two-car sprinter" lightweight vehicle with substantially evenly-distributed weight along the length of the train. The signature shown reflects the acoustic signal measured by a trackside transducer over time at a set region, located away from, and out of the influence of, "noisy" equipment, and shows the approach, passage and departure of a train. At a first region A of the signature, the acoustic signal corresponds to ambient or background noise only. At region B, a train approaches the transducer, and as it approaches the noise level increases. Region C occurs as the train passes the transducer. Since the train is assumed to be simple and with evenly distributed weight, this region generally takes the form of a plateau, i.e. there is a similar noise level experienced throughout passage of the train. However, there are points D of raised signal, which occur when individual wheels of the train pass by the transducer. Region E occurs after the passage of the train, and shows a gradually diminishing noise level as the train moves away. Finally, region F shows a return to ambient or background noise only.

Although not shown in FIG. 1, the signature will have a characteristic spectral response in the frequency domain, which advantageously is also monitored.

It can be seen from FIG. 1 that various types of information may be collated from the transducer's output. These include:

i) The train signature is unique for each train. Therefore comparison of detected signatures can be used to identify and differentiate trains. Furthermore trains may be tracked by means of the signature, as described below. It must be remembered though that the signature will be "squeezed" or "stretched" along the time axis depending on the speed of the train as it passes a transducer, and so compensation is necessary when identifying or tracking trains.

ii) The number of points D corresponds to the number of axles of the train. Therefore, the transducer may be used as an axle-counter.

iii) The profile of points D contains information as to the condition of the wheels and the condition of track where the wheels pass. If all such points D share a common unusual feature, then this implies that the track has a certain characteristic (e.g. a fault). If on the other hand a feature is only shown in one point D, then it may be implied that a particular wheel has a characteristic (e.g. a region of flattening). Furthermore the wheel affected may be determined.

iv) Other conditions of the train may be identified. For example, a signature including a high response at certain frequencies may imply "squealing" due to a fault. An unusual profile in region E may imply that an object is dragging along behind the train for example.

v) The signal outside the signature, i.e. the ambient noise in regions A, F, provides information on fixed equipment proximate the transducer, as will be described further below.

It should be noted that a single such signature cannot be used alone to determine either the length of the train or its speed. In order to enable these determinations, it is necessary to acquire at least one additional signature, i.e. from second transducer region.

There are various alternatives for providing fibre optic hydrophony proximate a track. These include:

i) providing a "long" fibre, i.e. one which is longer than the desired resolution of the system, alongside the track. The location of the source of acoustic signals may be determined by using signal processing, as is known in the art. This type of arrangement is schematically shown in FIG. 2, where a single length of optical fibre 1 is provided alongside a track 2. Signal detection is performed by a receiver 3 located at an end of the fibre 1. Receiver 3 is in connection with a signal processor 4. This outputs data to the main train control system (not shown). Alternatively, receiver 3 and signal processor 4 may be integrally formed.

ii) Providing a series of discrete fibres along the track, with each fibre having a length approximately equal to the desired resolution of the system. This arrangement is schematically shown in FIG. 3, where a number of fibres 1*a* are provided alongside track 2, each fibre being connected to a receiver 3. This arrangement may reduce processing load. It is possible to apply signal processing to the signal received from each fibre 1*a*, in order to further improve localisation of the acoustic signal source.

iii) Providing a "point" measurement with a short section of fibre to provide accurate determination of the acoustic signal source location without requiring the signal processing of i) above. This arrangement is shown in FIG. 4, with a number of short fibre sections 1*b* positioned proximate a track 2, each section 1*b* being connected to a receiver 3. This arrangement may be of particular use for monitoring fixed/trackside equipment such as points, crossings etc.

As mentioned above, the present invention provides various improvements over conventional systems. Some of these are now described for illustration.

1. Traction Immune Level Crossing Predictor

In a first embodiment, fibre optic cables—either new or already in place alongside the railway line—are used to determine the position of trains approaching a road/rail crossing (level crossing).

FIG. 5 schematically shows a conventional bi-directional level crossing predictor. Here, tracks 2 are provided with a number of treadles 5, which are activated by the physical passage of a train (not shown) as it approaches or departs from a level crossing 6. Activation of a treadle 5 by a train approaching the level crossing 6 causes barriers at the crossing to lower, i.e. to block the crossing to road users. Activation of a treadle 5 by a train as it leaves the level crossing causes the barriers to raise again, so that road users may cross. With this system, the barriers are controlled based on the position of a train, i.e. whether a train has reached the location of a treadle 5. A disadvantage with such a system is that the time between the train activating a treadle 5 on the approach to the level crossing 6 and the train reaching the level crossing 6 is dependent on the speed of the train. This means that road users are not given consistent warning of approaching trains.

A way to avoid this problem would be to control barrier activation dependent upon a determined time for a train to reach the level crossing. This embodiment provides such a method by the use of fibre optic hydrophony.

Analysis of sound vibrations detected by fibre optic hydrophony technology is used to determine when a train enters a section of interest, and to track its passage along the section of line. Since the location of the train is tracked, the speed v of the train may be determined by comparing the train's location at various times.

The tracking of movement is then used to determine the time at which the train will arrive at the crossing, for example using a simple t=s/v calculation, where v is the speed of the train, t is the estimated time of arrival and s is the distance of the train from the level crossing. Trackside machinery such as lights and/or barriers is then operated at a fixed time before the train's arrival.

The use of this technology is analogous to the use of existing track circuit-based level crossing predictors, but is completely immune to the type of traction and traction bonding being used—e.g. diesel, ac electric, dc electric etc. Conventional track circuits may not operate correctly with electric trains for example.

As a train passes a particular point on a railway line, there is a significant amount of noise and vibration created, this being detected by the sensing fibre optic cable. A train has a clear signature, i.e. vibration amplitude and/or frequency against time characteristic which is dependent on e.g. train type, trackside infrastructure and train speed. In particular, peaks are determined when axles pass a point on the railway, or a trackside anomaly such as an insulated rail joint, track joint, set of points, or indeed specifically placed target or targets (anomalies placed on the rail) that result in a characteristic vibration as a train wheel passes over it.

Due to the nature of train construction, and in particular the nature of the steel to steel wheel to rail interface, the signature of a train is very different to that of a car or other road vehicle. Having determined that a train is passing a particular position of the track, it is then possible to track the train as it moves towards a road crossing. By determining the time taken to travel a known distance between points on the fibre, it is possible to predict the time at which the train will arrive at the level crossing and thus provide a constant time warning to road users.

FIG. 6 schematically shows a level crossing detector in accordance with this embodiment, where reference numerals for similar components have been retained from FIG. 5. Here, an optical fibre 1 is laid proximate each rail 2. Acoustic signals are received from two specified spaced apart locations 7 and 8 on the approach to the crossing 6. Processing means (not shown) is used to analyse the signals received from locations 7 and 8, in particular the train signatures received therefrom. these are compared, e.g. by pattern matching, to ensure that the received signatures correspond to the same train. The speed of the train may then be determined, and thus the time of arrival at crossing 6. The barriers of crossing 6 may then be operated at a set time before that estimated arrival time.

Integrity may be further increased by determining that the signature at various points is the same as the vehicle moves along, thus ensuring that the same train is being tracked, and that there is no anomalous reading being made. This may be achieved using a pattern matching algorithm to compare received signatures. As noted previously, it is preferable to compensate the signatures for the speed of the train.

By tracking individual train signatures it is also possible to determine when a train or rail vehicle has changed direction, thus allowing safe tracking of train position regardless of direction. This is particularly relevant when works vehicles are being used on a section of railway.

Further safety can be provided by using similar technology on the road crossing itself to track the position of road vehicles as the cross the track. Again, signatures of road vehicles are dependent on e.g. their engine, and the wheel/road interface, particularly as structures such as the rail are struck. It is therefore possible to determine that vehicles that have entered the crossing have also safely passed over it. If this is not the case, then an appropriate action can be taken by the crossing control equipment, for example warning the driver to stop. Additional optical fibre transducer may be located proximate the road to assist in this monitoring, alternatively trackside fibre may be sufficient.

Should any doubt be raised by the tracking mechanism, then the level crossing equipment is caused to operate as a fallback fault condition.

2. Train Detection System

As a train passes a particular point on a railway line, there is a significant amount of noise and vibration created, much of this being detectable by the sensing fibre optic cable. As described above, each train has a clear signature, i.e. vibration amplitude and/or frequency against time characteristic which is dependent on e.g. train type, trackside infrastructure and train speed. In particular, peaks are determined when axles pass a point on the railway, or trackside anomaly such as an insulated rail joint, track joint, set of points, or indeed specifically placed target or targets (anomalies placed on the rail) that results in a characteristic vibration as a train wheel passes over it.

Further functionality may be provided in that the signature of the train will, as described above, be dependent on the number of axles on the train, the shape, deformation and condition of the wheels, the traction systems and so on. This can allow the tracking of multiple trains in the same section of track, and distinction between them.

2.1 Vital

In a second embodiment, train location is determined by the use of a fibre optic hydrophony system, in particular accurate determination of train position within a section of track as the the train moves along the railway. Such a system may be used with the methodology described in GB 1007073.8 for example. The hydrophony train detection system may be overlaid on to a conventional train detection system, such as one using track circuits or axle counter sections to provide additional resolution of position, such an arrangement being ideal for use in areas where increased resolution of train position detection can offer increased system performance, and at a potentially lower cost than a purely train-carried system.

In this embodiment, software is used to track trains safely as they move around a railway network. As in the first embodiment described above, the tracking may be performed using a pattern matching algorithm to compare received signatures. This allows the determination of train presence in 'virtual blocks' (i.e. any logical area of track), thus increasing safety of a system at potentially lower cost than conventional systems. Since the location of the acoustic signal source may be specified to the software, i.e. the software may be asked to "listen" to signals received from a particular location, the size of the virtual block can also be specified.

By tracking individual train signatures it is also possible to determine when a train or rail vehicle has changed direction, thus allowing safe tracking of train position regardless of direction. This is particularly relevant when works vehicles are being used on a section of railway. In this case it is necessary to "listen" to signals received from at least two locations.

The hydrophony train detection system may be overlaid with conventional detection systems, e.g. GPS, beacon, odometry, axle counters, track circuits, treadles or the like, to provide diversity, and fall-back in the event of failure of one detection system.

2.2. Non-Vital

In a third embodiment, train location is again determined by the use of a fibre optic hydrophony system. Here, this is not provided as a 'vital' system, but as a means of providing accurate information for applications such as "Real Time Information Systems", passenger information etc to railway stakeholders. This is particularly relevant where continuous train detection is not used and therefore positional accuracy is not certain. The fibre could for example comprise a new fibre optic cable, or a spare, dark fibre, in any existing system. Triggers could be based on either presence of noise having the signature of a train at a fixed point on the line, or by tracking movement through the section of track.

Passenger information can therefore be determined from knowledge of the timetable combined with knowledge about the train type and its location, giving accurate predictive information to passengers as to the time at which the vehicle is likely to arrive at a particular station, or to advise passengers at a station to stand back as a non-stopping train passes the location.

3. Railway Remote Condition Monitoring—Moving Assets

In this fourth embodiment, a fibre optic cable laid close to the trackside may be used to determine the status of moving railway assets such as rail vehicles.

As a train passes a particular point on a railway line, there is a significant amount of noise and vibration created, much of this being detectable by the sensing fibre optic cable. A train has a clear signature, i.e. vibration amplitude and/or frequency against time characteristic which is dependent on e.g. train type, trackside infrastructure and train speed. In particular peaks are determined when axles pass a point on the railway, or trackside anomaly such as an insulated rail joint, track joint, set of points, or indeed specifically placed target or targets (anomalies placed on the rail) that results in a characteristic vibration as a train wheel passes over it.

By detecting vibrations on the outer surface of the fibre, and in particular in comparison with a pre-recorded 'signature' for the particular object, it is possible to reveal faults including:

Wheels with 'flat spots'. Such a system is also known as "Wheel Impact Load Detection". As a wheel flat passes over the rail, and particularly over an anomaly such as a rail joint, or specially placed artificial anomaly, the signature of a wheel with a wheel flat passing that point is significantly different to that of a perfectly circular wheel. In particular the frequency domain analysis will show a large number of frequency components being detected due to the significant shock load placed on the wheel and track. It is also possible to check for such problems using an acoustic transducer provided on the train itself Hot wheel bearings (and later consequences such as locked wheels). Increased friction will cause a changed signature as the wheel moves along the rail, as stress waves pass over the wheel rail interface. In addition expansion of components within the wheel/bogie assembly will cause the time and/or frequency domain analysis to change.

High pressure air leaks (e.g. brake pipe or suspension components). The high frequency 'whistling' caused by such faults are easily picked up as the train travels past the sensing devices, resulting in a clearly identifiable profile in the frequency/time signature.

Pantograph (the apparatus used to pick up energy from overhead cables) high voltage arcs cause a 'white noise' which manifests itself as high amplitude components at a wide range of frequencies within the range of detection of the hydrophony system.

Dragging equipment which has fallen from a train, as it is dragged along the ballast will cause the train's signature to be radically changed, thus allowing feedback to be provided to the driver either through the railway signalling system, or through a message passed to the control centre.

Decoupled/uncoupled trains. Analysis of the received signature may be used to determine if a train has split, for example by counting the number of axle peaks.

4. Railway Remote Condition Monitoring—Fixed Assets

In this fifth embodiment, a fibre optic cable laid close to the trackside may be used to determine the status of fixed railway assets such as point machines, level crossing barriers and so on.

The vibration caused by the moving parts of the equipment will cause the outer layer of the fibre optic cable to vibrate, and this is picked up by the sensing equipment. Measurements of the signature of healthy equipment are made and recorded, in particular characteristics such as time of operation, and peaks of amplitude or vibration as areas of high friction are encountered.

By detecting vibrations on the outer surface of the fibre, and in particular in comparison with a pre-recorded 'signature' for the particular object, it is possible to reveal fixed asset faults including:

Track deformation, for example torsion of the rail or gauge corner cracking. As the train moves along the rail, the signature detected will be different to the 'normal' signature, for all axles, thus allowing detection with some surety that that rail is not as expected and that further inspection is required.

Switch and crossings suffering increased friction or slower operational times.

Point machines where condition is not optimal.

By using computer algorithms to determine trends in such characteristics, the system can determine at which point maintenance is required.

By adopting such a technique, no routine maintenance may be required, all maintenance can be based entirely upon the condition and operational status of the device being monitored.

Furthermore, this technique may be used to monitor vandalism, trespassing or theft at railside locations. If the noise expected to be created by an item disappears from a received signal, then this implies that the item has been physically removed, e.g. by theft. Abnormal signals received from an item may indicate vandalism of that item. In addition, the acoustic monitoring may be able to detect items not associated with the railway, e.g. monitoring intruders directly, for example footsteps, talking, or vehicles.

Various alternatives and modifications within the scope of the invention will be apparent to those skilled in the art. For example, although the foregoing description relates exclusively to the use of fibre optic hydrophony, where the acoustic transducer comprises a fibre optic cable, other forms of acoustic transducer may be used, for example microphones.

Preferably, the acoustic signals are monitored continuously, however this may not be necessary for all applications.

In the event of ambiguity in the interpretation of the received signal, it may be played to a human operator, who may be able to identify the noise picked up.

The methodology described above may be used in combination, e.g. the same received signals may be used both for train location and for monitoring of fixed assets.

The invention claimed is:

1. A method for predicting the time at which a train will arrive at a level crossing, the method comprising the steps of:

a) providing at least two spaced apart acoustic transducers, each having an optical fiber proximate a train track, the optical fibers picking up acoustic signals;

b) monitoring signals received from said transducers;

c) identifying a signature associated with said train from said received signals;

d) determining the speed of said train from analysis of said signatures; and e) estimating the arrival time of the train using the determined speed.

2. A method according to claim 1, which further comprises determining the position of the train from its signature.

3. A method according to claim 2, comprising the step of overlaying the determined train position information with information from a diverse train detection system.

4. A method according to claim 1, wherein the speed is determined by using signals received from at least two different locations.

5. A method according to claim 4, wherein the speed is determined by comparing the signatures received from said different locations.

6. A method according to claim 1, which further comprises determining the condition of the train.

7. A method according to claim 1, which further comprises determining the condition of the track.

8. A method according to claim 1, which further comprises identifying a signature associated with fixed assets.

9. A method according to claim 8, wherein the fixed assets include at least one asset selected from the group including: points, point machines, level crossings, cables, switches, track.

10. A method according to claim 1, which further comprises identifying items not associated with the railway.

11. A method according to claim 1, which further comprises the step of placing a target on the track to generate vibration as a train wheel passes over it.

12. A method according to claim 1, which further comprises providing a plurality of acoustic transducers located along the track.

13. A method according to claim 1, wherein step c) comprises comparing signatures received from each transducer to confirm that the signatures correspond to the same train.

14. Apparatus for monitoring and/or controlling components of a railway system which includes a track and at least one train that is operable to run on said track, the apparatus comprising:

at least two acoustic transducers each having an optical fiber proximate the railway, said optical fibers picking up acoustic signals;

at least two receivers for receiving the acoustic signals from the at least two acoustic transducers; and processing means for:

analyzing the received signals, identifying a signature associated with said train from said received signals, determining the speed of said train from analysis of said signatures, and estimating the arrival time of the train using the determined speed.

15. Apparatus according to claim 14, comprising a target located on the track to generate vibration as a train wheel passes over it.

* * * * *